United States Patent [19]

Douglass

[11] 4,032,447

[45] June 28, 1977

[54] OIL CLEANING SYSTEM COMPRISING AN ENGINE BLOCK ADAPTER AND CENTRIFUGAL CLEANING MEANS

[75] Inventor: Robert J. Douglass, Tolleson, Ariz.

[73] Assignee: The Raymond Lee Organization, Inc., New York, N.Y.

[22] Filed: Jan. 19, 1976

[21] Appl. No.: 650,570

[52] U.S. Cl. ..... 210/168; 184/6.28; 184/7 CR; 210/360 R; 233/19 R

[51] Int. Cl.² ..... F01M 11/02

[58] Field of Search ..... 233/2, 23 R, 19 R; 184/6.24, 6.28, 7 C, 7 CR; 210/167, 168, 360 R, 360 A

[56] References Cited

UNITED STATES PATENTS

| | | | |
|---|---|---|---|
| 2,268,653 | 1/1942 | Flowers | 184/6.24 |
| 2,324,763 | 7/1943 | Carruthers | 184/6.24 |
| 2,720,313 | 10/1955 | Pattison | 210/360 R |
| 3,078,958 | 2/1963 | Hoenick | 210/168 |
| 3,400,785 | 9/1968 | Allen | 210/168 |
| 3,415,383 | 12/1968 | Earle | 210/168 |
| 3,465,847 | 9/1969 | Donath et al. | 210/168 |
| 3,572,507 | 3/1971 | Juskevic | 210/168 |
| 3,572,582 | 3/1971 | Seielstad | 210/168 |
| 3,933,638 | 1/1976 | Isley | 210/360 A |

*Primary Examiner*—Frank W. Lutter
*Assistant Examiner*—Frank Sever
*Attorney, Agent, or Firm*—Stephen Wyden

[57] ABSTRACT

An adapter is mounted between an engine and a standard oil filter connected to a hydraulic motor which drives a centrifugal drum, the adapter also delivers metered quantities of the oil to an inside of the centrifugal drum, and an outlet from the centrifugal drum returns the oil to the engine, an outlet from the hydraulic motor returns the oil to the adapter to pass through the standard oil filter before being returned to the engine.

2 Claims, 1 Drawing Figure

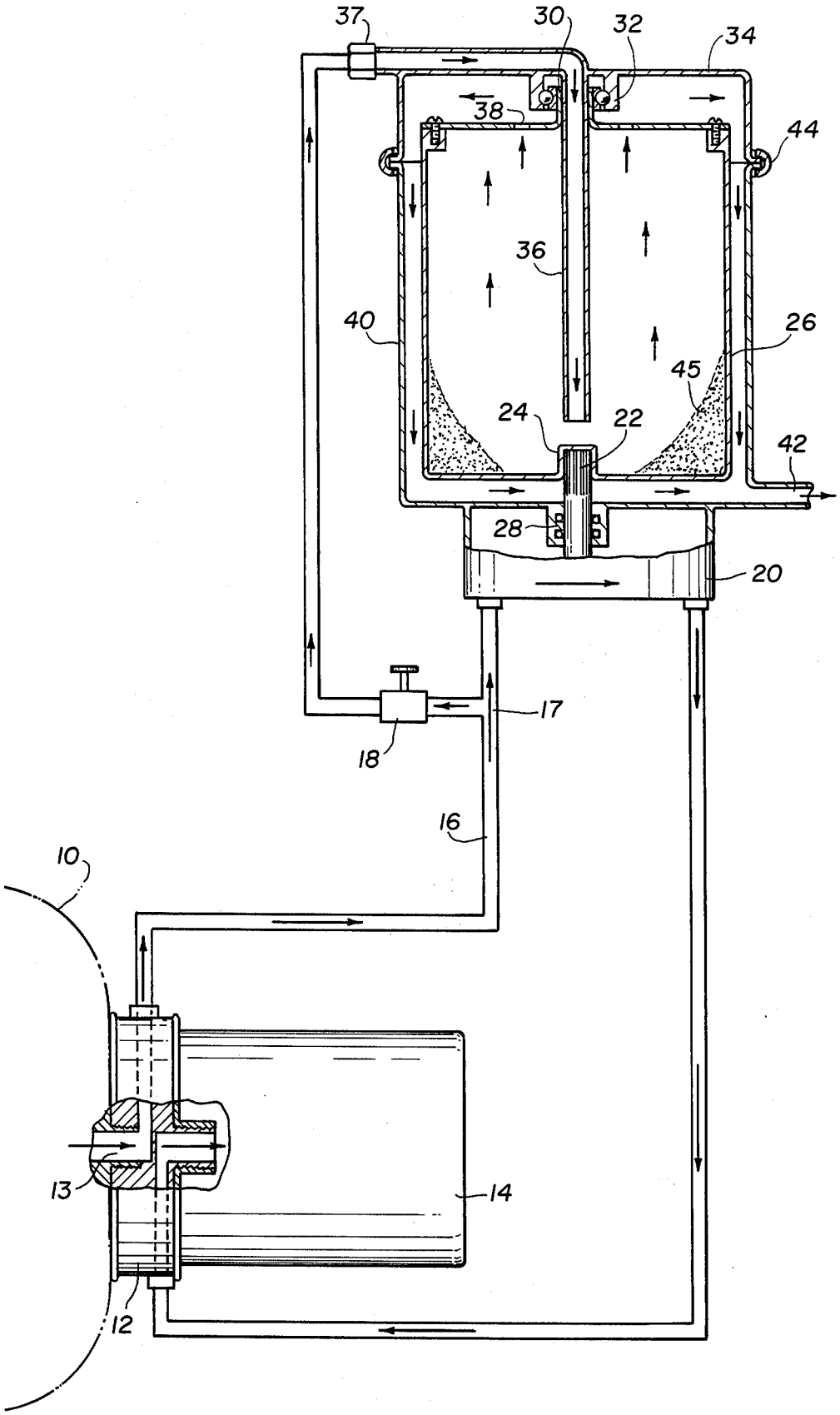
37
30
32
34
38
44
36
40
26
45
24
22
42
28
20
17
18
16
10
13
14
12

OIL CLEANING SYSTEM COMPRISING AN ENGINE BLOCK ADAPTER AND CENTRIFUGAL CLEANING MEANS

I have invented a new and novel centrifugal oil cleaner. My centrifugal oil cleaner is driven hydraulically by the pressure of the oil pump that normally drives the oil through the standard oil filter. Furthermore, my centrifugal oil cleaner can be mounted via an adapter between an engine block and a standard oil filter to offer additional cleaning and safety for the oil used in the engine.

My invention can be understood in view of the accompanying sole FIGURE.

The FIGURE shows the device mounted on an engine.

In the FIGURE, an engine 10 is fitted with an adapter 12 between the oil outlet 13 and the standard oil filter 14. A pipe 16 from the adapter 12 carries the pressurized oil to a bifurcation 17. A valve 18 meters the flow of oil to be cleaned. Part of the flow of oil from the pipe 16 is directed to an hydraulic motor 20 which then returns the oil back to the adapter to circulate through the standard oil filter 14. The hydraulic motor 20 forms a splined drive shaft 22 which receives a splined receiver 24 of a centrifugal drum 26 and rotates in a bearing 28. The neck 30 of the drum 26 is journaled in a bearing 32 mounted in a cover 34. The cover forms an inlet pipe for the oil 36 connected by a joint 37 to the pipe receiving oil from the valve 18. Outlet holes 38 for the oil from the centrifugal drum 26 carry the oil to the walls of the housing 40 to an outlet 42 for return on the centrifuged oil to the engine oil, 10. The cover 34 is connected by a seal 44 to the walls of the housing 40 so that all the oil passing along the walls of the housing 40 is delivered to the outlet 42. The rigid configuration of the cover seal and walls also provides for pivotal support for the centrifugal drum 26 as it rotates on the bearings 32 and 28. Waste materials 45 that may collect inside the centrifugal drum 26 are indicated.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An oil cleaning system, comprising:

an adapter mounted on an engine block in communication with the oil outlet of said engine block, and a standard oil filter, mounted directly on said adapter, a pipe connected to the adapter for carrying oil to a valve, a hydraulic motor connected to the pipe, said motor having means for returning oil through the adapter so as to pass the oil through the standard oil filter, an oil inlet connected to the valve and passing through a cover into a centrifugal drum, said valve functioning to distribute oil flow from said adapter, between said oil outlet and said hydraulic motor, the cover sealably mounted to a housing, means for rotatably supporting an upper end of the centrifugal drum attached to the cover and surrounding the inlet pipe, a drive shaft extending from the hydraulic motor engaging a bottom surface of the centrifugal drum and supported by a bearing at a bottom of the housing to rotate the centrifugal drum, an outlet from the centrifugal drum at an upper surface of the centrifugal drum thereof to permit oil to leave the centrifugal drum and pass along a wall of the housing to an outlet from the housing, and means of returning the oil to the engine from the outlet from the housing.

2. The centrifugal oil cleaner of claim 1 wherein a distal end of the drive shaft has a spline, the bottom surface of the centrifugal drum has a spline receiver for receiving the splined distal end of the drive shaft, and the upper surface of the centrifugal drum has a neck journaled in a bearing mounted in the cover of the housing of the centrifugal cleaner.

* * * * *